US005242888A

United States Patent [19]

Atherton et al.

[11] Patent Number: 5,242,888

[45] Date of Patent: Sep. 7, 1993

[54] POLYMERIC MATRIX FOR THERMAL TRANSFER RECORDING

[75] Inventors: David Atherton, North Kingstown; Kang Sun, Coventry, both of R.I.

[73] Assignee: Arkwright, Incorporated, Fiskeville, R.I.

[21] Appl. No.: 733,741

[22] Filed: Jul. 24, 1991

Related U.S. Application Data

[63] Continuation-in-part of Ser. No. 470,347, Jan. 25, 1990, abandoned.

[51] Int. Cl.[5] ..... B41M 5/035; B41M 5/38

[52] U.S. Cl. ..... 503/227; 428/195; 428/212; 428/213; 428/422; 428/500; 428/913; 428/914

[58] Field of Search ..... 8/471; 428/195, 913, 428/914, 212, 213, 422, 500; 503/227

[56] References Cited

U.S. PATENT DOCUMENTS

| | | | |
|---|---|---|---|
| 2,718,476 | 9/1955 | Eichorn | 117/76 |
| 2,831,793 | 11/1955 | Elmendorf | 154/45.9 |
| 3,235,443 | 2/1966 | Greenman et al. | 162/165 |
| 4,315,643 | 2/1982 | Tokunaga et al. | 428/213 |
| 4,463,034 | 7/1984 | Tokunaga et al. | 427/256 |
| 4,474,844 | 10/1984 | Omori et al. | 428/216 |
| 4,555,427 | 11/1985 | Kawasaki et al. | 428/195 |
| 4,572,684 | 2/1986 | Sato et al. | 400/240.4 |
| 4,615,938 | 10/1986 | Hotta et al. | 428/323 |
| 4,686,549 | 8/1987 | Williams et al. | 503/227 |

FOREIGN PATENT DOCUMENTS

| | | | |
|---|---|---|---|
| 0164074 | 12/1985 | European Pat. Off. | 503/227 |
| 228835 | 7/1987 | European Pat. Off. | 503/227 |
| 59-194888 | 11/1984 | Japan | 503/226 |
| 60-49997 | 3/1985 | Japan | 503/227 |
| 60-154096 | 8/1985 | Japan | 503/227 |
| 60-174695 | 9/1985 | Japan | 503/227 |
| 2158094 | 7/1987 | Japan | 503/227 |
| 63-237986 | 10/1988 | Japan | 503/227 |
| 63-237988 | 10/1988 | Japan | 503/227 |
| 63-237989 | 10/1988 | Japan | 503/227 |

*Primary Examiner*—B. Hamilton Hess

*Attorney, Agent, or Firm*—Birch, Stewart, Kolasch & Birch

[57] ABSTRACT

A receptor sheet for use in thermal transfer recording is provided comprised of a polymeric matrix which contains at least one hard polymeric element with a softening temperature higher than that of the ink donor layer and at least one soft polymeric element with a softening temperature lower than that of the ink donor layer.

34 Claims, No Drawings

POLYMERIC MATRIX FOR THERMAL TRANSFER RECORDING

This application is a continuation-in-part of application Ser. No. 07/470,347 filed on Jan. 25, 1990, now abandoned, the entire contents of which are hereby incorporated by reference.

BACKGROUND AND FIELD OF THE INVENTION

This invention relates in general to a polymeric matrix and in particular to a polymeric matrix for use on a receptor medium utilized in thermal transfer recording.

One of the more important non-impact printing technologies is the thermal transfer printing process. It has several advantages over traditional mechanical impact printing, such as high resolution, low noise level and high speed. However, a thermal transfer printer requires a printing medium tailored for its specific process.

The thermal transfer process is complex with the final imaging results dependent not only on the receptor sheet, but also the donor sheet and printer. Thus the ink composition and the printer design play a role in the quality of the imaged product. This invention teaches how generally to obtain good performance.

The thermal transfer printing process involves three components: a thermal print head, a thermal transfer ribbon consisting of a foundation and a heat-sensitive ink donor layer applied thereon, and an ink receptor sheet. The inked side of the thermal transfer ribbon is placed in contact with the ink receptor sheet, and heat from the thermal print head is applied to the backside of the thermal transfer ribbon. The heat is conducted through the plastic or paper ribbon and locally raises the ink (colorant and carrier matrix) temperature above its softening point. The softened ink partially wets the ink receptor sheet, transfers to it and re-solidifies.

It is known to those skilled in the art to choose compatible materials in the donor and receptor components. Compatibility is often discussed in terms of solubility parameters (Handbook of Adhesives, 2nd Edition, I. Skeist, published by van Nostrand, 1977).

A wide variety of different types of thermal transfer ink receptor media have been proposed heretofore. For example, Japanese Patent 63-237,989 describes an ink-receptor sheet containing two aromatic polyamide layers having different roughness; Japanese Patent 64-072,662 describes a two-layer ink-receptor sheet comprising a metal oxide layer and an adhesion layer; Japanese Patent 64-072,663 describes an ink-receptor sheet consisting of a sponge urethane or a foam styrene; and Japanese Patent 63-69,685 describes an ink-receptor sheet containing an aluminum silicate and a polymer binder. Some patents describe wax-containing and wax compatible ink receptor layers. Examples of such patents include Japanese Patents 59-229,394, 60-49,997, 60-174,695, 60-154,096, 64-072,664, 63-237,988, 63-170,087 and European Patent Publication 228,835 (U.S. Pat. No. 4,686,549). Some patents describe ink receptor layers coated on an opaque substrate such as paper. Examples of such patents include Japanese Patents 60-49,997, 60-54,891, 59-229,394, 63-17,079, 61-139,487, 60-56,594, 63-237,986, 62-173,293, 63-77,780, and 59-194,888.

Despite the substantial prior art, none have achieved the image quality required by the end user. Density is frequently low and half tones are poorly rendered, resulting in inadequate tonal quality.

We have now devised a polymeric matrix which is particularly suitable as an ink receptor medium for thermal transfer recording.

SUMMARY OF THE INVENTION

An object of the present invention is to provide a receptor medium for use in thermal transfer printing which is capable of producing recorded images having improved image density and resolution.

An important feature of this invention is to formulate a polymeric matrix for use on a receptor medium containing at least one hard polymeric element and one soft polymeric element. The term "element" as used herein is intended to include a collection of molecular units which exhibit a softening temperature. Hard and soft are relevant in this context because they indicate the state of "elements" in the temperature range of use in the thermal transfer machine. In this regard, some aspects of this invention comprise matrices which contain one or more elements which undergo thermal transition (or initiate it) below 30° C. and at least one element which does reach a defined softening point until above 90° C. Soft and hard elements may individually be homopolymers, copolymers, terpolymers or other polymeric materials, or combinations thereof. The polymeric matrix may also contain a pigment, a surface active agent and a conductive agent and other additives.

An element is called "hard" if its softening temperature ($T_s$) is higher than the melting point of the ink donor layer and an element is called "soft" if its $T_s$ is lower than the melting point of the ink donor layer. While the exact mechanism is not understood, it is believed that the hard elements provide desired density gradation, resolution and handling properties, and the soft elements provide desired adhesion, density and uniformity. Thus the combined effect of the soft and hard elements of the invention is to produce prints with high density in the full density area and good dot resolution in the half tones for rendition of continuous tone subject matter.

DETAILED DESCRIPTION OF THE INVENTION

A receptor sheet, in general, comprises a backing, or base film, and an image receptive layer.

The base film may be comprised of various materials, and numerous suitable supports are known in the art and commercially available. Examples of materials suitable for use as base substrates include paper, polyesters, polysulfones, polycarbonates, poly(vinylchloride), poly(vinylacetate), polyolefins, polystyrenes and cellulose esters. Specific examples include polypropylene, cellulose acetate, cellulose acetate butyrate, and, most preferably, polyethylene terephthalate. These support materials can be transparent or opaque depending upon the ultimate use of the final product. A pretreat may be utilized on and may be considered a part of the base substrate to provide adhesion to the polymeric matrix.

The image receptor layer according to the invention, is comprised of a polymeric matrix, optionally in combination with a pigment, a surface active agent and/or a conductive (anti-static) agent.

The polymeric matrix should have the following characteristics:

1. At least one element in the polymeric matrix has a softening temperature that is lower than that of the ink donor layer, i.e. a soft element.

2. At least one element in the polymeric matrix has a softening temperature that is higher than the melting point of the ink donor layer, i.e. a hard element, preferably such that the difference between the two is not too great, particularly not greater than 125° C., especially not greater than 100° C.

3. It can be coated on plastics or paper.

4. It is stable to light and has good heat stability.

5. It is an optically uniform, non-tacky and uniform coating, i.e. free of reticulation or streaks.

6. It is an aqueous based formulation, solution or dispersion, substantially free of organic solvents, and therefore environmentally preferred over prior products.

In addition to the above characteristics, a commercially useful receptor sheet should also feed reliably through thermal transfer printers. Those receptor sheets to be used for transparencies must also be transparent to light and handleable under conditions typically encountered during use of overhead transparencies. The receptor layer must be so designed as to achieve suitable physical properties in addition to the imaging qualities described herein. The physical properties include haze level, surface durability, feed reliability, and coating uniformity, among others. These are conventional requirements routinely addressed in formulating films for printing and copying by means of suitable choices of surface active agents, pigments, antistatic agents and other additives. The final product design is usually comprised of an optimum balance between the required imaging and physical properties.

The polymer matrix can be comprised of a copolymer, a combination of homopolymers, a combination of copolymers, or a combination of homopolymers and copolymers.

Copolymers employed in the polymeric matrix according to the invention are preferably block copolymers or graft copolymers.

The hard elements have softening temperatures that are higher than that of the ink donor layer. The presence of hard elements apparently ensures that desired image resolution, density gradation and handling properties can be achieved. The hard elements are preferably either homopolymers or copolymers comprising or derived from polycarbonate, polymethyl methacrylate, polyurethane, polyetherpolyurethane, polyethyl methacrylate, acrylonitrile, methacrylonitrile, vinyl alcohol, ethylene terephthalate, ethylene, propylene, butene, hexene, vinyl butyl ether, vinyl chloride, acrylic acid, methacrylic acid, ethacrylic acid, unsaturated esters, epoxy, styrene, among others. The hard elements can also be obtained by crosslinking otherwise soft elements having crosslinkable functional groups, such as hydroxyl terminated polyester polyurethanes.

The soft elements have softening temperatures that are lower than that of the ink donor layer. The soft elements appear to give desired image density, adhesion and uniformity. The soft elements may be structurally similar to the binders employed in the ink donor layer. Such soft elements may include polymers or copolymers comprising or derived from methyl acrylate, ethyl acrylate, butyl acrylate, ethylene, propylene, butadiene, isobutene, n-hexyl methacrylate, vinyl acetate, styrenebutadiene, ethyleneacrylic acid, vinyl acetate-acrylic acid, styrene-butyl acrylate, vinyl methyl ether, vinyl ethyl ether, vinyl butyl ether, siloxane, urethane, vinylidine chloride, ethylene adipate, and hexamethylene n-butyl methacrylate.

Various combinations of hard and soft elements are possible, but consistent within the important requirements of the invention is that the polymeric matrix comprise at least one hard element and at least one soft element. The hard element should have a $T_s$ of at least about 5° C. higher than that of the ink donor layer, and the soft element should have a $T_s$ of at least about 5° C. lower than that of the ink donor layer. Preferably, the hard element should have a $T_s$ of from 10° to 50° C. higher than the melting point of the donor ink, most preferably from 20° to 40° C. (especially about 30° C.), above the $T_s$ of the donor layer, and the soft element should have a $T_s$ of from 30° to 60° C., most preferably from 40° to 50° C. (especially about 45° C.), lower than the $T_s$ of the donor layer.

The amount of the hard and soft elements can vary to achieve the desired characteristics. If the polymeric matrix is too hard, then the product will exhibit poor transfer from the donor sheet. On the other hand, if the polymeric matrix is too soft, it can exhibit too much transfer and suffer from tackiness and other handling problems. Generally, therefore, the matrix should contain from 5 to 90% soft elements.

The polymeric matrix of the receptor sheet comprising the soft and hard elements, surface active agents, conductive agents and other additives must of course be compatible with the ink of the receptor sheet to obtain an effective ink transfer.

Evaluation of a product for determining a proper balance of hard and soft elements can be done by evaluating the half tones. Best density and resolution results are obtained when there is a substantial difference ($\Delta T_s = T_s^{\circ}$ (hard) $- T_s^{\circ}$ (soft)) between the softening temperature of the soft element and that of the hard element, said difference being at least about 60° C. In general, products wherein $\Delta T_s$ is from about 30° to 90° C. can provide good results, but preferred products possess a $\Delta T_s$ of from about 60°-80° C. While a lesser softening temperature differential may produce acceptable results, the present inventors have discovered that a superior result can be obtained with the recommended higher temperature difference. Although it is not entirely understood why the better results are obtained at the higher temperature differential, and the inventors do not wish to be bound to any specific theory, it is believed this is because the softer element and the harder element each serves its function more effectively when their softening temperatures differ by a significant amount than when they are so close that the best contribution from each is lost. Thus the soft element can more effectively provides the desired adhesion, density, cohension, and uniformity and the hard element can more effectively provides the density gradation, resolution and handling properties. In a most preferred embodiment, the $T_s$ of the soft element is less than 30° C. and the $T_s$ of the hard element is more than 90° C. However, the $\Delta$ Ts should not be too great and particularly should not be greater than 125° C., preferably not greater than 100° C., to avoid problems which can be encountered with some rubber based formulations. Thus, the softening temperature of the soft element can range from −30° to 29° C., especially from 0° to 29° C. and the softening temperature of the hard element can range from 85° to 120° C.

A product produced according to the invention provides regularly shaped, well defined dot transfer which gives excellent half tones. This is evident from an optical microscopic examination of the dot shape and size, or from a visual examination of the half tones of imaged samples.

The polymeric matrix of the invention can be comprised of various combinations from the above suggested hard and soft elements, so long as the matrix contains at least one hard and at least one soft element. Softening temperature, $T_s$, as used herein, means the temperature of the initial endothermic deflection from the baseline into a glass transition upon heating a sample with no discrete melting point, or, for materials which do exhibit a melting point as an endothermic extremum, the melting point itself, when the heating and measuring is done generally in accordance with ASTM D3418-82. Minor variations in the method may be made so long as the heating rate is from about 10° to 20° C./min, the purge gas is nitrogen or argon, and the measurement range is at least 10° C. to 150° C., the sample is in the upper temperature range in the first heating cycle for at least 2 minutes before, and the quench is down to about 0° C.

In view of the growing number of makes and models of Thermal Transfer Printers and the variety of donor sheets, it is particularly advantageous to provide a so-called universal product; one that would function well in most thermal imaging systems. This is accomplished by the present invention which provides an improved thermal transfer image receptive medium which comprises a polymer based substrate having a coating on a first surface thereof and, optionally, a second coating on a second surface thereof. The coating on the first surface comprises (A) from about 90 to about 10 percent of a soft element polymeric material having a softening temperature below about 30° C. and (B) from about 10 to 90 percent of a hard element polymeric material having a softening temperature above about 90° C.

The soft element may particularly be a copolymer of 2 to 4 alkyl esters of unsaturated monocarboxylic acids which contain from 3 to 11 carbon atoms.

The hard element may particularly be a copolymer comprised of 4 to 6 monomers, wherein the monomers are selected from a $C_{2-6}$ olefin, a $C_{3-9}$ unsaturated carboxylic acid or a salt thereof, acrylic acid, a $C_{4-11}$ alkyl acrylic acid or an alkyl ester thereof and styrene or monosubstituted styrene. The monomers are preferably contained in relative amounts such that (1) the olefin to carboxylic acid or salt therof weight ratio is from about 70:30 to about 98:2;

(2) the acrylic acid, $C_{4-11}$ alkyl acrylic acid or alkyl ester thereof to styrene or monosubstituted styrene weight ratio is from about 1:3 to about 1:1; and (3) the ratio of the total weight of the olefin and unsaturated carboxylic acid or salt thereof to the total weight of the alkyl acrylate and styrene or monosubstitute styrene is from about 60:40 to about 85:15.

An important useful hard element is a graft copolymer comprised of a backbone of an olefin, such as ethylene, propylene, butadiene, or butene perfluorethylene, functionalized with an acid group such as acrylic, methacrylic, itaconic and maleic acids to which backbone is appended copolymers of butadiene or styrene and alkylesters of acid moieties such as acrylic, methacrylic, itaconic, maleic acid. The molecular weight of this class of compounds covers the range of from 2000 to one million. The preferred ratio of the pendent group to the backbone is in the range of 35:65 to 20:80.

A surface active agent, such as wetting agent, dispersing agent, defoaming agent and anti-foaming agent, etc., may be incorporated into the polymer matrix to modify the surface properties, lower the critical surface tension, and improve the coatability. While any number of surface active agents may be utilized, alkylaryl sulfonates, such as those made by Rohm and Haas, are preferred, such as Triton X200, Triton 770 and Triton GRM. These surface active agents are particularly suited as aqueous coating aid, and have a further advantage at times of reducing the surface conductivity of the polymeric matrix.

Examples of conductive (anti-static) agents that may be employed to help provide reliable feed include sulfonated polystyrene, poly(dimethyl diallyl ammonium chloride), copolymers of dimethyl diallyl ammonium chloride and diacetone acrylamide, quaternary cellulose acetate and other conductive materials.

The desired surface resistivity of the receiving sheet may be about $1\times10^{7}$–$1\times10^{13}$ ohms/sq. at 50% relative humidity and 20° C. Desired surface resistivity values can be attained by incorporation into the product of per se known surface active agent. Anionic agents have been found to be particularly useful in achieving the desired surface resistivity values for the products of the invention. The amount of the surface active agent can vary, but is usually from 0.1 to 2.0% of the total composition dry weight.

A particularly preferred anionic active agent is a sodium salt of alkylaryl polyether sulfonate which is an anionic surface active agent commercially available as Triton x 200, Rohm and Haas. This surface active agent improves compatibility of the polymers employed and additionally confers a measure of conductivity. Other useful surface active agents include a sodium salt of alkylaryl polyether sulfonate, commercially available as Triton 770, Rohm and Haas, and a dioctyl sodium sulfosuccinate, commercially available as Triton GR5M, Rohm and Haas.

In the preferred formulation, the use of 1.7% by weight of Triton X200 reduces the log surface resistivity from 16 to 10.4–10.9 ohms per square at 50% RH. Triton GR5M (dioctyl sodium sulfocuccinate) provides a coated log resistivity of 11.2 ohms per square at 50% RH.

Pigments useful in the invention are those which are utilized in the art for printing media, for example, calcium carbonate, titanium oxide, Kaolin, silicon dioxides, aluminum hydroxide, polyolefin particulates such as polyethylene, polypropylene or polytetrafluoroethylene, microcrystalline cellulose, glass beads, etc. These and other organic and inorganic pigment particles can be used to modify the surface properties of the medium and particularly offer increased stacking, feeding, recoatability, abrasion resistance, slip, and anti-blocking characteristics. Most preferably the incorporation of the pigment particle in the polymer matrix gives a Sheffield surface smoothness of from about 5 to 100. A coefficient of friction of about 0.2 to 0.5 is employed in this invention which is typical of those used in receptor sheets for automatically fed copying and electronic printing devices. A polymeric matrix for the transparent ink receptive sheet of this invention comprises about 0.05 to about 10% pigment particle by weight of the dried coating for a transparent sheet. A polymeric matrix for a reflective opaque ink receptive sheet comprises about 0% to about 70% opaque pigment by weight of the dried coating. The preferred embodiment of this invention employs a wax coated silica commercially available as Syloid 169, in the formulation to provide the surface roughness and coefficient of friction characteristics necessary to achieve reliable feed and blocking resistance with minimum increase in haze. The mean particle size of this agent is 2.5–3 microns and the wax coated silica particles provide compatibility with the polymers and solvents in the formulation thereby by reducing settling of the particles.

The coating solution or dispersion, which is used for the formation of the polymer matrix on the polymeric base film substrate or paper, is preferably derived from an aqueous solution or dispersion. Trace organic additives such as methanol, butylcellulose, ethanol, methyl carbitol, and the like, may be employed in combination with water, if desired.

An additional latex coalescing agent may also be used in the receptor sheet to improve leveling, scrub resistance, gloss, adhesion, and enamel holdout. Various useful coalescing agents are known in the art and comprise high-boiling solvents such as butyl cellosolve acetate, hexylene glycol, ethylene glycol, tributyl-ethyl phosphate, and propylene glycol monomethyl ether.

Any of a number of coating methods may be employed to prepare the receptor sheets according to the invention, such as roller coating, wire-bar coating, rod, blade, dip-coating, air-knife coating, spray coating, curtain coating, doctor coating, gravure coating, reverse roll coating, stretch-flow coating, bead coating or extrusion coating. The matrix layer is preferably coated to a thickness of about 0.05 to 0.50 mil, to produce a dry coat weight of about 0.04 to 4.0 g/M$^2$.

The polymeric matrix of this invention can be applied to one or both sides of the supporting base film substrate. In those products with a coating on both sides, the polymeric matrices on the sides of the supporting substrate need not necessarily be identical. The coat weight of a dried coating is preferably about 0.05 to about 4 grams per square meter of coating, although workable coatings may be achieved with lesser or greater coat weights. If the coating on both sides is the same, i.e. if the backcoat is of the same composition as the facecoat, then the product is described as being "symmetrical".

Although symmetrical receptor sheets are usually employed, at times it is preferable to have a removable backing sheet adhesively adhered to the nonimaging side of the film. For some electronic printers, this construction will facilitate transport through the printer. The backing sheet is preferably paper, but also may be a polymeric material. At other times the non-imaging side may have a polymeric coating of such composition as to help provide reliable transport.

The receptor layer of this invention may also be utilized on one or both sides of a white opaque substrate to produce a glossy finish for the final reflection print. The receptor layer maintains the optical brightness and other viewing attributes of the white, highly opaque base in reflected light. Alternatively, a partially transmissive white, opaque base support may be employed for applications requiring backlighting. The finish of the receptor film which is normally glossy may in turn be altered to provide a matte finish through appropriate choice of known matting agents.

As noted above in a thermal transfer printing process, printing is accomplished by the application of heat from the thermal print head to the thermal transfer ribbon or donor sheet which softens the ink and transfers it to the receptor sheet. Such donor sheets comprise a backing or base layer with a coating layer of donor material. Various donor sheets known in the art are useful in the present invention, including for example those described in U.S. Pat. Nos. 4,474,744; 4,572,624; 4,463,034 and 4,315,643. One useful commercially available sheet is that sold by Cal Comp for Model 5602 Color Master Plotter.

Other commercially available donor (ribbon) sheets are those sold by Seiko and Versatec. As examples, the following commercially available donor (ribbon) sheets have the following softening temperatures ($T_s$):

| Type | Color | $T_s$ (°C.) |
|---|---|---|
| Cal Comp | Blue | 66 |
| Cal Comp | Red | 66 |
| Cal Comp | Yellow | 65 |
| Seiko | Blue | 72 |
| Seiko | Red | 72 |
| Seiko | Yellow | 71 |
| Versatec | Blue | 69 |
| Versatec | Red | 69 |
| Versatec | Yellow | 69 |

In such known donor sheets, the backing or base layer is generally a paper or plastic film, such as laminated, synthetic, or glasine paper; or polyester, styrene acrylonitrile, polypropylene, polystyrene or polyethylene films.

The transfer or ink layer is comprised of a coloring agent, in combination with a binder and softening agent. Various known compositions can be used in the invention by first ascertaining the melting point of the donor sheet, and then appropriately selecting at least one compatible hard element and one compatible soft element for use in the receptive sheet.

The following examples are provided to more specifically describe the invention, but are not to be considered to limit the scope of the invention.

Formulation Embodiments

The following examples show particular formulations according to the invention, as well as comparative examples to show the importance of the discovery of the present invention. When testing the products of the examples, unless otherwise specified, Examples 1 through 6 were printed on a CalComp Colormaster, Thermal Transfer Printer. Likewise, unless otherwise specified, examples 7 through 14 were printed on a Versatec Model C2700 Thermal Transfer Printer. The examples were printed using the appropriate donor sheet described above.

The chemical names listed for the individual components of the formulations are those believed to represent the manufacturers' trade names.

The following procedure was used for the preparation of product according to the examples.

A polyethylene terephthalate film used as a light-transmissive substrate was coated on its surface with the formulations according to each of the following Examples 1 through 6 by means of a Meyer rod coater so as to have a dried film thickness of 2 g/m$^2$, followed by drying at 120° C. for 1 minute.

EXAMPLE 1

| Example 1 | |
|---|---|
| 76 RES 7800 (50.0%)[1] | 24.0 parts |
| Rhoplex AC-73 (46.5%)[2] | 15.0 parts |
| Rhoplex B-85 (38.0%)[2] | 9.0 parts |
| Versa-TL 125 (6%)[3] | 3.8 parts |
| Surfynol 104 Surfactant[4] | 0.2 parts |
| Water | 48.0 parts |

[1]76 RES 7800 - A copolymer of vinyl acetate - acrylic acid sold by Unocal Chemical Division, Unocal Corporation ($T_s$ = 22° C.)
[2]Rhoplex AC73 - a copolymer of methylmethacrylate ethylacrylate, ($T_s$ = 23° C.) and Rhoplex B-85 - A poly(methyl methacrylate) ($T_s$ = 88° C.) both sold by Rohm & Haas Company.
[3]Versa-TL 125, a sulfonated polystyrene, sold by National Starch & Chemical Corporation
[4]Surfynol 104 surfactant sold by Air Products & Chemicals, Inc.

Media prepared according to this example gave good results in both full density and half tone areas.

| Example 2 | |
|---|---|
| Rhoplex AC-73 (46.5%) | 8.47 parts |
| Rhoplex B-85 (38.0%) | 3.50 parts |
| Rhoplex HA-16 (45.5%) | 30.15 parts |
| Shamrock S-395[2] | 0.06 parts |
| Ammonium Hydroxide | 0.37 parts |
| Syntran 9253 (40.0%)[3] | 12.99 parts |
| Syloid 169[4] | 0.06 parts |
| Surfynol 104[5] | 0.07 parts |
| Cellosolve Solvent | 1.07 parts |
| Water | 43.25 parts |

[1]Rhoplex HA-16 - copolymer of butyl methacrylate and isobutyl methacrylate (Ts = 18° C.) sold by Rohm & Haas Company.
[2]Shamrock S-395 a polyolefin pigment sold by Shamrock Chemicals Corporation.
[3]Syntran 9253 - a copolymer of ethylene styrene-butyl acrylate-acrylic acid (Ts = 97° C.) sold by Interpolymer Corporation.
[4]Syloid 169, a wax coated silica sold by W.R. Grace & company
[5]Surfynol 104, a surface active agent sold by air Products & Chemicals, Inc.

Media prepared according to this example gave good results in both full density and half tone areas.

| Example 3 | |
|---|---|
| Rhoplex B-88 (42.5%)[1] | 27.27 parts |
| Syntran 9253 (40.0%) | 45.45 parts |
| Water | 22.73 parts |
| Cellosolve Solvent | 0.045 parts |

[1]Rhoplex B-88 - a modified poly (methyl methacrylate) ($T_s$ = 62° C.) sold by Rohm & Haas Company Media prepared according to this example gave marginal results in terms of the half tone area.

| Example 4 | |
|---|---|
| Syntran 9253 (40%) | 60 parts |
| Water | 40 parts |

Media prepared according to this example gave generally poor film forming properties.

| Example 5 | |
|---|---|
| Airflex 410[1] (55%) | 50 parts |
| Water | 50 parts |

[1]Airflex 410 - a copolymer of vinyl acetate and ethylene ($T_s$ = < 0° C.) sold by Air Products and Chemicals, Inc.

The media prepared according to this example were too soft and tacky to be useful.

| Example 6 | |
|---|---|
| CMC 12M8[1] | 1 Part |
| Water | 99 Parts |

[1]CMC 12M8 - sodium carboxymethylcellulose ($T_s$ = > 100° C.) sold by Hercules.

Media prepared according to this example are too hard and exhibit poor image transfer.

| Example 7 | Wgt. % |
|---|---|
| 1) Rhoplex AC73 | 34.13 |
| 2) Syntran 9253 | 14.77 |
| 3) Triton X200 | 1.17 |
| 4) Syloid 169 | 0.20 |
| 5) Water | 49.73 |

1) Rohm & Haas AC73. Copolymer of methylmethacrylate ethylacrylate, $T_s$ of 23° C.
2) Interpolymer Syntran 9253. Copolymer of ethylene-styrene-butylacrylate acrylic acid having a $T_s$ of 97° C.
3) Rohm & Haas Triton X200. Surfactant sodium salt of alkylaryl polyether sulfonate 20% anionic in water.
4) W.R. Grace Syloid 169. 2.5 - 3 micron silica coated with wax.

Preparation

The Triton X200 and Syloid 169 are added to water and mixed for 10 minutes followed by the Rhoplex AC73 and Syntran AX9-253.

The mix is applied on ICI Melinex 054 clear or 339 white opaque or 377 translucent 3 mil gauge polyester film using a No. 4 meyer rod. The wet coating is dried at 130° C. for 2 minutes. The dry coat weight is about 1.7 g/m$^2$.

One or both sides may be coated.

A product prepared according to this example provides excellent density, resolution and tonal range, and satisfactory functional physical performance (feed, haze, scratching, blocking), when printed on CalComp, Seiko and Versatec thermal printers.

| Example 8 | Wgt. % |
|---|---|
| 1) Rhoplex B924 | 40.89 |
| 2) Syntran 9253 | 14.77 |
| 3) Triton X200 | 1.17 |
| 4) Syloid 169 | 0.20 |
| 5) Water | 42.99 |

1) Rohm and Haas Rhoplex B924. Copolymer of methylmethacrylate butylacrylate and methacrylic acid. Estimated $T_s$ is about 38° C.
2) Interpolymer Syntran 9253. Copolymer of ethylene-styrene-butylactylate acrylic acid having a $T_s$ of 97° C.
3) Rohm & Haas Triton X200. Surfactant sodium salt of alkylaryl polyether sulfonate 20% anionic in water.
4) W.R. Grace Syloid 169. 2.5 - 3 micron silica coated with wax.

Preparation

The Triton X200 and Syloid 169 are added to water and mixed for 10 minutes followed by the Rhoplex B924 and Syntran AX9-253.

The mix is applied on ICI Melinex 054 clear or 339 white opaque or 377 translucent 3 mil gauge polyester film using a No. 4 meyer rod. The wet coating is dried at 130° C. for 2 minutes. The dry coat weight is about 1.7 g/m$^2$.

A product prepared according to this example provides very good density, resolution and tonal range, and satisfactory functional, physical performance (feeding, haze, scratching).

| Example 9 | Wgt. % |
|---|---|
| 1) Rhoplex AC73 | 34.15 |
| 2) Syntran PA 1445 | 14.40 |
| 3) Triton X200 | 1.17 |
| 4) Syloid 169 | 0.20 |
| 5) Water | 50.11 |

1) Rohm & Haas AC73. Copolymer of methylmethacrylate and ethylacrylate, $T_s$ = 23° C.
2) Interpolymer Syntran PA 1445. Copolymer of ethylene-styrene-butylacrylate acrylic acid having an estimated $T_s$ greater than 100° C.
3) Rohm & Haas Triton X200. Surfactant sodium salt of alkylaryl polyether sulfonate 20% anionic in water.
4) W.R. Grace Syloid 169. 2.5 - 3 micron silica coated with wax.

Preparation

The Triton X200 and Syloid 169 are added to water and mixed for 10 minutes followed by the Rhoplex B924 and Syntran AX9-253.

The mix is applied on ICI Melinex 054 clear or 339 white opaque or 377 translucent 3 mil gauge polyester film using a No. 4 meyer rod. The wet coating is dried at 130° C. for 2 minutes. The dry coat weight is about 1.7 g/m$^2$.

A product prepared for this example provided good density, resolution and tonal range, and satisfactory functional, physical performance (feeding, haze, stacking).

| Example 10 | Wgt. % |
|---|---|
| 1) Rhoplex AC73 | 23.19 |
| 2) Syntran 9253 | 27.95 |
| 3) Triton X200 | 1.17 |
| 4) Syloid 169 | 0.20 |
| 5) Water | 47.49 |

1) Rohm & Haas AC73. Copolymer of methylmethacrylate ethylacrylate, $T_s$ = 23° C.
2) Interpolymer Syntran 9253. Copolymer of ethylene-styrene-butylacrylate acrylic acid having a $T_s$ of 97° C.
3) Rohm & Haas Triton X200. Surfactant sodium salt of alkylaryl polyether sulfonate 20% anionic in water.
4) W.R. Grace Syloid 169. 2.5 - 3 micron silica coated with wax.

Preparation

The Triton X200 and Syloid 169 are added to water and mixed for 10 minutes followed by the Rhoplex AC73 and Syntran 9253.

The mix is applied on ICI Melinex 054 clear or 339 white opaque or 377 translucent 3 mil gauge polyester film using a No. 4 meyer rod. The wet coating is dried at 130° C. for 2 minutes. The dry coat weight is about 1.7 g/m$^2$.

A product prepared for this example provided good density, resolution and tonal range.

| Example 11 | Wgt. % |
|---|---|
| 1) Rhoplex AC73 | 41.74 |
| 2) Syntran 9253 | 5.59 |
| 3) Triton X200 | 1.17 |
| 4) Syloid 169 | 0.20 |

-continued

| Example 11 | Wgt. % |
|---|---|
| 5) Water | 51.3 |

1) Rohm & Haas AC73. Copolymer of methylmethacrylate ethylacrylate, $T_s$ = 23° C.
2) Interpolymer Syntran 9253. Copolymer of ethylene-styrene-butylacrylate acrylic acid having a $T_s$ of 97° C.
3) Rohm & Haas Triton X200. Surfactant sodium salt of alkylaryl polyether sulfonate 20% anionic in water.
4) W.R. Grace Syloid 169. 2.5 - 3 micron silica coated with wax.

Preparation

The Triton X200 and Syloid 169 are added to water and mixed for 10 minutes followed by the Rhoplex AC73 and Syntran 9253.

The mix is applied on ICI Melinex 054 clear or 339 white opaque or 377 translucent 3 mil gauge polyester film using a No. 4 meyer rod. The wet coating is dried at 130° C. for 2 minutes. The dry coat weight is about 1.7 g/m$^2$.

A product prepared for this example provided good results in terms of resolution and tonal range.

| Example 12 | Wgt. % |
|---|---|
| 1) Rhoplex AC73 | 34.13 |
| 2) Rhoplex B85 | 15.16 |
| 3) Triton X200 | 1.17 |
| 4) Syloid 169 | 0.20 |
| 5) Water | 49.34 |

1) Rohm and Haas Rhoplex AC73. Copolymer of methylmethacrylate ethylacrylate, $T_s$ = 23°.
2) Rohm and Haas Rhoplex B-85. A poly (methylmethacrylate) $T_s$ = 88° C.
3) Rohm & Haas Triton X200. Surfactant sodium salt of alkylaryl polyether sulfonate 20% anionic in water.
4) W.R. Grace Syloid 169. 2.5 - 3 micron silica coated with wax.

Preparation

The Triton X200 and Syloid 169 are added to water and mixed for 10 minutes followed by the Rhoplex AC-73 and Roplex B85.

The mix is applied on ICI Melinex 054 clear or 339 white opaque or 377 translucent 3 mil gauge polyester film using a No. 4 meyer rod. The wet coating is dried at 130° C. for 2 minutes. The dry coat weight is about 1.7 g/m$^2$.

The results of this example showed relatively low density and resolution.

| Example 13 | Wgt. % |
|---|---|
| 1) Rhoplex HA-16 | 35.26 |
| 2) Syntran 9253 | 14.77 |
| 3) Triton X200 | 1 17 |
| 4) Syloid 169 | 0.20 |
| 5) Water | 48.21 |

1) Rohm and Haas Rhoplex HA-16 selfcrosslinking copolymer believed to be comprised of a methylmethacrylate and ethylacrylate, $T_s$ = 18° C.
2) Interpolymer Syntran 9253. Copolymer of ethylene-styrene-butylacrylate and acrylic acid having a $T_s$ of 97° C.
3) Rohm & Haas Triton X200. Surfactant sodium salt of alkylaryl polyether sulfonate 20% anionic in water.
4) W.R. Grace Syloid 169. 2.5 - 3 micron silica coated with wax.

Preparation

The Triton X200 and Syloid 169 are added to water and mixed for 10 minutes followed by the Rhoplex HA-16 and Syntran AX9-253.

The mix is applied on ICI Melinex 054 clear or 339 white opaque or 377 translucent 3 mil gauge polyester film using a No. 4 meyer rod. The wet coating is dried at 130° C. for 2 minutes. The dry coat weight is about 1.7 g/m$^2$.

A product prepared according to this sample showed good density and tonal range.

| Example 14 | Wgt % |
|---|---|
| 1) Rhoplex AC73 | 48.90 |
| 2) Triton X200 | 1.17 |
| 3) Syloid 169 | 0.20 |
| 4) Water | 49.73 |

1) Rohm & Haas AC73. Copolymer of methylmethacrylate ethylacrylate $T_g$ = 23° C.
2) Rohm & Haas Triton X200. Surfactant sodium salt of alkylaryl polyether sulfonate 20% anionic in water.
3) W.R. Grace Syloid 169. 2.5 - 3 micron silica coated with wax.

Preparation:

The Triton X200 and Syloid 169 are added to water and mixed for 10 minutes followed by the Rhoplex AC73.

The mix is applied on ICIMelinex 054 clear or 339 white opaque or 377 translucent 3 mil gauge polyester film using a No. 4 meyer rod. The wet coating is dried at 130° C. for 2 minutes. The dry coat weight is approximately 1.7 g/m$^2$.

This example showed relatively lower density and poor resolution of the halftones resulting in rather poor overall image quality.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A receptor sheet suitable for use in a thermal mass transfer recording process for receiving donor material from an ink donor layer, said receptor sheet comprising a base substrate and, coated on at least one surface of said base, a substantially homogenous polymeric matrix comprised of at least one hard element and at least one soft element, wherein the hard and the soft element are mutually compatible;

said hard element being a homopolymer or copolymer with a softening temperature higher than that of said ink donor layer; and said soft element being a homopolymer or copolymer with a softening temperature lower than that of said ink donor layer.

2. The receptor sheet according to claim 1, wherein the difference between the softening temperatures of said soft and hard elements is not greater than 125° C.

3. The receptor sheet according to claim 1, wherein the difference between the softening temperatures of said soft and hard elements is not greater than 100° C.

4. The receptor sheet according to claim 1 or 3, wherein the polymeric matrix further contains at least one member selected from the group consisting of a pigment, a surface active agent and a conductive agent.

5. The receptor sheet according to claim 4, wherein said soft element is a homopolymer or copolymer comprised of methyl acrylate, ethyl acrylate, butyl acrylate, ethylene, propylene, butadiene, isobutene, methylmethacrylate, n-hexyl methacrylate, vinyl acetate, caprolactam, oxymethylene, vinyl methyl ether, vinyl ethyl ether, vinyl butyl ether, siloxane, urethane, vinylidine chloride, ethylene adipate, hexamethylene adipamide, n-propylmethacrylate, n-butyl methacrylate, n-hexyl methacrylate, n-octyl methacrylate, and tetramethylene sebacate, or a polymer selected from the group consisting of petroleum resins, styrene-butadiene, ethylene-acrylic acid, vinyl acetate-acrylic acid, styrene-butyl acrylate, cellulose acetate, cellulose ethers and cellulose nitrate.

6. The receptor sheet according to claim 4, wherein said hard element is a homopolymer or copolymer derived from polymethylmethacrylate, polyethyl methacrylate, acrylonitrile, methacrylonitrile, vinyl alcohol, ethylene terephthalate, vinyl butyl ether, polycarbonate, vinyl chloride, acrylic acid, unsaturated esters, epoxy styrene, phenol formaldehyde and urethane.

7. The receptor sheet according to claim 4, wherein said soft element is a copolymer comprised of a member selected from the group consisting of methylmethacrylate, ethylacrylate and butylacryate and said hard element is a copolymer comprised of a member selected from the group consisting of methylmethacrylate and ethylmethacrylate.

8. The receptor sheet according to claim 1, wherein said hard and soft elements have a softening temperatures of at least about 5° C. higher or lower, respectively, than that of the donor layer.

9. The receptor sheet according to claim 1, wherein said hard element has softening temperatures of from 20° to 40° C. higher than that of the donor layer and said soft element has a softening point of from 40° to 50° C. lower than that of the donor layer.

10. A receptor sheet according to claim 1, wherein the difference between the softening temperature of said soft and hard elements is between 30° to 90° C.

11. A receptor sheet according to claim 10, wherein said difference is between 60° to 80° C.

12. A thermal transfer image receptive medium suitable for use in a thermal mass transfer recording process for receiving donor material from an ink donor layer, said image receptive medium comprising:

a base substrate; and a substantially homogenous polymeric matrix coated on at least one surface of said base substrate, and comprising about 90 to 10% of a soft element polymeric material and from about 10 to 90% of a hard element, wherein the soft and hard elements are mutually compatible;

said soft element having a softening temperature below about 30° C. and being a copolymer comprised of 2 to 4 alkyl esters of unsaturated monocarboxylic acids which contain from 3 to 11 carbon atoms; and said hard element having a softening temperature above about 90° C. and being a copolymer comprised of 4 to 6 monomers, wherein the monomers are selected from the group consisting of a $C_{2-6}$ olefin, a $C_{3-9}$ unsaturated carboxylic acid or a salt thereof, acrylic acid, a $C_{4-11}$ alkyl acrylic acid, or an alkyl ester thereof and styrene or monosubstituted styrene, wherein said monomers are contained in amounts such that (a) the weight ratio of said olefin to said carboxylic acid or salt thereof is about 70:30 to about 98:2, (b) the weight ratio of said alkyl acrylate to said styrene or monosubstituted styrene is about 1:3 to about 1:1, and (c) the weight ratio of the total weight of said olefin and said unsaturated carboxylic acid or a salt thereof to the total weight of said acrylic acid, alkyl acrylic acid or alkyl ester thereof and styrene or monosubstituted styrene is about 60:40 to 85:15.

13. A thermal transfer image receptive medium according to claim 12, which further comprises a surface active agent selected from the group consisting of a sodium salt of alkylaryl polyether sulfonate and a dioctyl sodium sulfosuccinate.

14. A thermal transfer image receptive medium according to claim 12 or 13, wherein said polymeric matrix is coated on both surfaces of said base substrate, and wherein the coating on the first surface is from about 50 to 200% the thickness of that of the coating on the second surface.

15. A thermal transfer image receptive medium according to claim 12, wherein said $C_{2-6}$ olefin is a member selected from the group consisting of ethylene, propylene and perfluoroethylene.

16. A thermal transfer image receptive medium according to claim 12 or 15, wherein said $C_{3-9}$ unsaturated carboxylic acid is acrylic acid.

17. A thermal transfer image receptive medium according to claim 12 or 15, wherein said acrylic acid ester is n-butylacrylate.

18. A thermal transfer image receptive medium according to claim 12, wherein said hard element is a copolymer comprised of ethylene, acrylic acid, n-butylacrylate and styrene.

19. A thermal transfer image receptive medium according to claim 18, wherein said soft element is a copolymer of methylmethacrylate and butylmethacrylate.

20. A thermal transfer image receptive medium according to claim 18, wherein said soft element is a copolymer of methylmethacrylate and ethylacrylate.

21. A thermal transfer image receptive medium according to claim 18, 19 or 20, which further comprises a sodium salt of alkylaryl polyether sulfonate as a surface active agent.

22. A thermal transfer image receptive medium according to claim 18, wherein said polymeric matrix is an aqueous based formulation.

23. A thermal transfer image receptive medium according to claim 12, wherein said soft element has a softening temperature of between 0° to 29° C., and said hard element has a softening temperature of between 85° to 120° C.

24. A thermal transfer image receptive medium suitable for use in a thermal mass transfer recording process for receiving donor material from an ink donor layer, said image receptive medium comprising:

a base substrate; and a substantially homogenous polymeric matrix coated on at least one surface of said base substrate, and comprising from about 10 to 90% of a copolymer comprised of 4 to 6 monomers, wherein the monomers are selected from the group consisting of a $C_{2-6}$ olefin, a $C_{3-9}$ unsaturated carboxylic acid or a salt thereof, acrylic acid, a $C_{4-11}$ alkyl acrylic acid, or an alkyl ester thereof and styrene or monosubstituted styrene, wherein said monomers are contained in amounts such that (a) the weight ratio 70:30 to about 98:2, (b) the weight ratio of said alkyl acrylate to said styrene or monosubstituted styrene is about 1:3 to about 1:1, and (c) the weight ratio of the total weight of said olefin and said unsaturated coboxylic acid or a salt thereof to the total weight of said alkyl acrylate and styrene or monosubstituted styrene is about 60:40 to 85:15.

25. The thermal transfer image receptive medium according to claim 24, wherein the polymeric matrix further contains at least one member selected from the group consisting of a pigment, a surface active agent and a conductive agent.

26. A thermal transfer image receptive medium according to claim 24 or 25, wherein said polymeric matrix is coated on both surfaces of said base substrate, and wherein the coating on the first surface is from about 50 to 200% the thickness of that of the coating on the second surface.

27. A thermal transfer image receptive medium according to claim 24, wherein said $C_{2-6}$ olefin is a member selected from the group consisting of ethylene, propylene and perfluoroethylene.

28. A thermal transfer image receptive medium according to claim 24, wherein said $C_{3-9}$ unsaturated carboxylic acid is acrylic acid.

29. A thermal transfer image receptive medium according to claim 24, wherein said acrylic acid ester is n-butylacrylate.

30. A thermal transfer image receptive medium according to claim 24, wherein said hard element is a copolymer comprised of ethylene, acrylic acid, n-butylacrylate and styrene.

31. A thermal transfer image receptive medium according to claim 24, which further comprises a soft element which is a copolymer of methylmethacrylate and butylmethacrylate.

32. A thermal transfer image receptive medium according to claim 24, wich further comprises a soft element which is a copolymer of methylmethacrylate and ethylacrylate.

33. A thermal transfer image receptive medium according to claim 24, which further comprises a soft element which has a softening temperature of between 0° to 29° C.

34. A thermal transfer image receptive medium according to claim 24, wherein said polymeric matrix is an aqueous based formulation.

* * * * *